US011096482B2

(12) United States Patent
Anderson et al.

(10) Patent No.: US 11,096,482 B2
(45) Date of Patent: Aug. 24, 2021

(54) BENCHING SYSTEM FOR VERTICALLY ADJUSTABLE DESKS

(71) Applicant: Squaregrove, LLC, Austin, TX (US)

(72) Inventors: Eric W. Anderson, Austin, TX (US); Jon Daniel Paulsen, Austin, TX (US)

(73) Assignee: SQUAREGROVE, LLC, Austin, TX (US)

( * ) Notice: Subject to any disclaimer, the term of this patent is extended or adjusted under 35 U.S.C. 154(b) by 0 days.

(21) Appl. No.: 16/601,867

(22) Filed: Oct. 15, 2019

(65) Prior Publication Data

US 2020/0128951 A1 Apr. 30, 2020

Related U.S. Application Data

(60) Provisional application No. 62/749,930, filed on Oct. 24, 2018.

(51) Int. Cl.

| | |
|---|---|
| ***A47B 21/02*** | (2006.01) |
| ***A47B 87/00*** | (2006.01) |
| ***A47B 9/20*** | (2006.01) |

(52) U.S. Cl.

CPC ..... *A47B 21/02* (2013.01); *A47B 9/20* (2013.01); *A47B 87/002* (2013.01); *A47B 2087/004* (2013.01)

(58) Field of Classification Search

CPC ..... A47B 21/02; A47B 9/20; A47B 87/002; A47B 87/00; A47B 87/005; A47B 2087/004; A47B 2200/0066; A47B 21/00; A47B 17/065; A47B 91/028; F16B 2/241; Y10T 403/3906; Y10T 403/57; Y10T 403/32131; Y10T 403/32139;

(Continued)

(56) References Cited

U.S. PATENT DOCUMENTS 2,067,101 A * 1/1937 Shaw ..... A47B 3/00 248/188.91

2,694,614 A 11/1954 Dent (Continued)

FOREIGN PATENT DOCUMENTS

AU 2014202902 A1 12/2014

DE 2106622 * 9/1972

(Continued)

OTHER PUBLICATIONS

Steelcase Inc., https://www.steelcase.com/products/benching/series-bench/, 2019. (Accessed Oct. 15, 2019) 8 Pages.

(Continued)

*Primary Examiner* — Janet M Wilkens

(74) *Attorney, Agent, or Firm* — Middleton Reutlinger

(57) ABSTRACT

A vertically adjustable desk benching system wherein a plurality of desks may be joined together. The vertically adjustable desks may each have a planar work surface and telescoping support legs which are operable to raise and lower the work surface. The vertically adjustable support legs may be telescoping legs. The benching system may include a main bracket which attaches to a plurality of adjoining vertically adjustable desks while a first and a second end bracket may attached front facing desks on either side of the centrally adjoining main bracket.

20 Claims, 12 Drawing Sheets

(58) Field of Classification Search
CPC ..... Y10T 403/32147; Y10T 403/32155; Y10T 403/32163; Y10T 403/32172; A47C 1/124
USPC ..... 108/20, 64, 65, 147, 50.02, 50.01, 180, 108/186, 190; 248/200, 300, 125.2, 248/188.7, 677, 188.8, 205.1; 211/187, 211/182, 85.3
See application file for complete search history.

(56) References Cited

U.S. PATENT DOCUMENTS 3,303,246 A * 2/1967 Forrest ..... A47B 91/024 264/510
3,697,130 A * 10/1972 Barecki ..... A47C 3/04 297/248
3,964,401 A * 6/1976 Gutmann, Jr. ..... A47B 83/001 108/64
4,366,758 A * 1/1983 Brecher ..... A47B 87/002 108/155
4,498,802 A * 2/1985 Del Tufo ..... E04B 1/6116 403/300
4,665,836 A * 5/1987 Burr ..... A47B 87/002 108/59
5,182,996 A 2/1993 Gutgsell
5,428,928 A * 7/1995 Hellwig ..... A47B 21/06 108/147
5,522,324 A 6/1996 Van Gelder et al.
5,568,775 A * 10/1996 Rizzi ..... A47B 87/002 108/64
5,794,545 A 8/1998 Mcdaniel et al.
6,024,024 A 2/2000 Favaretto
6,422,781 B1 * 7/2002 Ofcharsky ..... H02G 3/086 174/59
6,598,542 B2 7/2003 Goldberg et al.
6,935,247 B2 8/2005 Schaefers et al.
8,291,833 B2 10/2012 Skiba
8,763,965 B1 * 7/2014 Peay ..... A47L 15/427 248/205.1
9,179,768 B2 11/2015 Stubbs et al.
9,282,823 B2 * 3/2016 Kumazawa ..... A47C 1/124
9,332,839 B2 5/2016 Ringlein
10,111,523 B2 * 10/2018 Caratiola ..... A47B 17/065
10,349,736 B2 * 7/2019 Tseng ..... A47B 9/04
2002/0195848 A1 * 12/2002 Seitz ..... A47C 3/16 297/248
2009/0078167 A1 * 3/2009 Ellegaard ..... A47B 9/00 108/21
2010/0176634 A1 * 7/2010 Wahl ..... A47C 13/005 297/248
2011/0036274 A1 2/2011 Poost et al.
2014/0360413 A1 12/2014 Schenk et al.
2015/0023729 A1 1/2015 Henriott et al.
2017/0086581 A1 * 3/2017 Gammon ..... A47B 87/002

FOREIGN PATENT DOCUMENTS

DE 3918860 A1 12/1990
DE 9109880 * 9/1991
DE 202010014601 * 1/2012
EP 0476315 A1 3/1992
FR 1250595 * 1/1961
FR 2964845 * 3/2012

OTHER PUBLICATIONS

UPLIFT Desk, https://www.upliftdesk.com/content/4-leg-assembly-instructions.pdf. 2018, Version v4.1, 12 Pages.
Bouroullec et al., https://www.vitra.com/en-us/product/tyde 2012. (Accessed Oct. 15, 2019) 10 Pages.

* cited by examiner

BENCHING SYSTEM FOR VERTICALLY ADJUSTABLE DESKS

BACKGROUND

Vertically adjustable desks typically include a work surface which is supported by a first and a second leg, both the first and the second let of the desk are vertically adjustable to change the elevation of the work surface. Such adjustable desks are becoming more popular due to the flexible height of the work surface and the ability of the user to sit at the desk work surface or stand at the work surface of the desk. Further, while it is common to join multiple non-adjustable desks into connected work surfaces, joining vertically adjustable desks is challenging due to the adjustability of the work surface and the variety of support legs which are typically utilized for raising and lowering the support surface.

SUMMARY

This specification is directed generally to systems and mechanisms which allow for joining of a plurality of vertically adjustable desks. Joining a plurality of vertically adjustable desks at multiple locations can be accomplished even though the support surfaces of the desks change and the support legs of the desk are vertically adjustable. Joining the desks can include joining a common proximity point of the plurality of desks with a main bracketing system for benching of the desks into a single joined configuration. Further, end brackets may be utilized to join the proximate end support foot of the desks at either side of the joined configuration.

Various implementations of benching system described herein incorporate the ability to join a plurality of vertically adjustable desks, including a plurality of desks which may be positioned in a first and a second pair of desks being positioned in a side to side relationship. Additionally the ability to combine a plurality of desk together into a configuration of multiple joined desks may be implemented as described herein, particularly after individual desks are installed, without the need to further update or modify the supporting hardware. Further, the two pairs of desks may be positioned into a quadrant of desks, wherein the two pairs of side to side joined vertically adjustable desks may be paired in front to front relationship. In such configuration, the quadrant of desks may be joined with a main bracket and a pair of end brackets. Alternative configurations of the plurality of desks may be implemented, such as multiple pairs, multiple quadrants, three desks, and other combinations, while utilizing many of the same benching system components set forth here. The specific implementations therefor utilized herein to describe and set forth the various embodiments are not to be deemed limited beyond their purposes for describing the multiple implementations.

In some implementations, a benching system is provided for connecting a plurality of vertically adjustable desks. Each of the plurality of the vertically adjustable desks includes a work surface which is supported by a first and a second telescoping support legs which may each have a foot or other stabilizer at the end of the respective leg to provide support for the leg and the work surface.

The desks may further include an electric motor which are operable to raise and lower the first and second support legs. For example, in some implementations, the electric motor may be replaced by a manual adjustment mechanism, such as a hand crank or a hydraulic based system. In other implementations, the electric motor may be attached to a switch allowing the user to selectively raise and lower the vertical positional height of the work surface.

In implementations, the benching system may also include a main bracket and end brackets for affixing a plurality of the vertically adjustable legs together. For example, the main bracket, in embodiments, may be removably attached to the plurality of the vertically adjustable desks. In aspects, the main bracket may be removably attached to the first leg of each of the plurality of the vertically adjustable legs. In additional embodiments, the benching system may further include a first and a second end bracket wherein each of the first and the second end brackets are affixed to a subset of plurality of vertically adjustable desks and to a second leg of each of the subset of plurality of vertically adjustable desks.

These and other implementations disclosed herein may optionally include one or more of the following features.

In embodiments, the main bracket of the benching system may be removably attached to four vertically adjustable legs. For example, in such implementations, the main bracket may be affixed to the first leg at a first foot for each of the plurality of vertically adjustable desks. In other implementations, the first and the second end brackets may each be affixed to a subset of the plurality of the vertically adjustable desks. For example, in some implementations, this subset each be two vertically adjustable desks. In embodiments, the first and second end brackets may each be affixed to the second leg of the subset of the vertically adjustable desks.

For example, in one implementation, the benching system disclosed may join a plurality of four vertically adjustable desks wherein the main bracket removably attaches to each of the four desks. Further, in various implementations, benching system disclosed may include the end brackets which each join a subset of the four desks, for example two desks.

For example, in another embodiment, the benching system disclosed may include a main bracket which is an I-shaped bracket. The main bracket may be attached to the four vertically adjustable desks at four corners of the main bracket. The main bracket may further include, in implementations, offset brackets at each of the attachment points of the main bracket to each of the plurality of vertically adjustable desks.

The end brackets may be modified in many ways to include or incorporate structure at the support foot of the vertically adjustable desk. For example, in implementations, each of the two end brackets of the benching system may slidably receive a leveling pad or a caster on a foot attached to a telescoping leg from adjoining vertically adjustable desks.

In still other aspects and implementations, the disclosure herein is directed towards a vertically adjustable desk benching system which includes a plurality of vertically adjustable desks wherein each of the desks have a horizontal work surface supported by a first and a second vertically adjustable leg. Each of the first and second vertically adjustable legs further has a support foot.

The desks described herein may be vertically adjustable. For example, in embodiments, the first and second vertically adjustable legs include an electric drive, where the vertically adjustable legs telescope to vertically adjust the height of the supported horizontal surface by the action of the electric drive in each of the leg. In other embodiments, a single electric drive is operable to vertically adjust the telescoping first and second adjustable legs.

In embodiments, the vertically adjustable desks may be joined in many configurations. For example, the plurality of vertically adjustable desks of the benching system may be positioned in a side to side relationship wherein a first and a second pair of the vertically adjustable desks are side by side. As well, the first and the second pair of the vertically adjustable desks may, in implementations, be positioned in front to front relationship so that the plurality of four desks form a quadrant and adjacent relationship.

In further aspects, the vertically adjustable desk benching system may include a main bracket which is affixed to at least one of the vertically adjustable legs of each of the plurality of the vertically adjustable desks.

In still further aspects, the vertically adjustable desk benching system may include a first and second end bracket which are each removably affixed to a respective first pair of opposing ones of the vertically adjustable legs of the respective ones of the desks, the respective pair of the opposing legs being opposite the legs affixed to the main bracket.

In some implementations, the vertically adjustable benching system may include a main bracket which is removably affixed to four adjacent vertically adjustable desks. In implementations, the support foot for each of the first and the second vertically adjustable legs extend away from the respective vertically adjustable leg and thereby extend in either direction to both a first and a second distal end. As well, in embodiments, the main bracket in the vertically adjustable benching system may include or incorporate in addition thereto four attachment points for the four adjacent vertically adjustable desks. In addition or in place thereof, in some implementations the four attachment points may be removably affixable to the support foot of the first vertically adjustable leg of each of the respective plurality of vertically adjustable desks.

The main bracket may be implemented to support multiple structures of the support legs of the desks. For example, in some implementations the main bracket may be I-shaped.

In various other implementations, the desk benching system set forth herein may include with the main bracket four attachment points, each of the attachment points having a vertically offset bracket support affixed to the main bracket attachment points, each of the offset brackets positioned between the main bracket and the respective support foot of the vertically adjustable leg of the respective vertically adjustable desk.

As well, in some embodiments, the end brackets may be removably attachable to the respective foot of the respective vertically adjustable desk. For example, the first and second end brackets each may have a first and a second U-shaped channel each of which receives a stud supporting a leveling pad or caster on the respective support foot of the respective vertically adjustable leg for the respective desk.

In an additional implementation of the vertically adjustable desk benching system, the vertically adjustable desks may be joined in many configurations. For example, the plurality of vertically adjustable desks of the benching system may be positioned in a triad configuration wherein three desks are placed in an angular side by side relationship. For example, the triad configuration may include desks having an interior edge and angled exterior edges wherein the plurality of desks can form the triad of three vertically adjustable desks. These desks can be positioned in such adjacent supporting position. For example, the support foot of the first vertically adjustable leg of a desk may be positioned adjacent to the support foot of the second vertically adjustable leg of an adjacent desk from the plurality of vertically adjustable desks.

In various embodiments, these desks may include main brackets for removably affixing the adjacent desks together. For example, the main bracket may be an arcuate main bracket removably affixable to the support foot of the first vertically adjustable leg of a vertically adjustable desk and to the support foot of the second vertically adjustable leg of an adjacent desk.

In further implementations, the plurality of main brackets may be shaped to appropriately fit the joined and adjacent desks. For example, the main brackets may be arcuate brackets. As well, various aspects, the brackets may have first and second ends and be appropriately curved to affix to the adjacent decks. For example, the main brackets may be arcuately shaped and have an arcuate interior edge and an arcuate exterior edge.

It should be appreciated that all combinations of the foregoing concepts and additional concepts described in greater detail herein are contemplated as being part of the subject matter disclosed in this specification. For example, all combinations of claimed subject matter appearing at the end of this disclosure are contemplated as being part of the content and subject matter disclosed herein.

DETAILED DESCRIPTION

Various implementations of vertically adjustable desks utilize a benching system that incorporate positioning of brackets to attach or affix adjacent desks into a combined benched format in order to keep the desks aligned with each other allowing the users to work in a group and providing an organized working space. Beneficially, the system described herein easily connects multiple single desks without replacement of the individual desk assembly. Particularly, the systems variously described allows the desks to be adjusted from single desks to a benched design and back again with simple addition of additional hardware without adjusting or modifying existing vertically adjustable desk hardware.

Various implementations disclosed herein enable benching of multiple vertically adjustable desks while allowing the joining of the desks without removing and/or replacing the various support structures of each of the desks. Moreover, the various systems described herein disclose a system and method which allow the benching or combination of vertically adjustable desks while utilizing the same desk structure to readily combine the desks into an organized and joined format.

Figure 1:
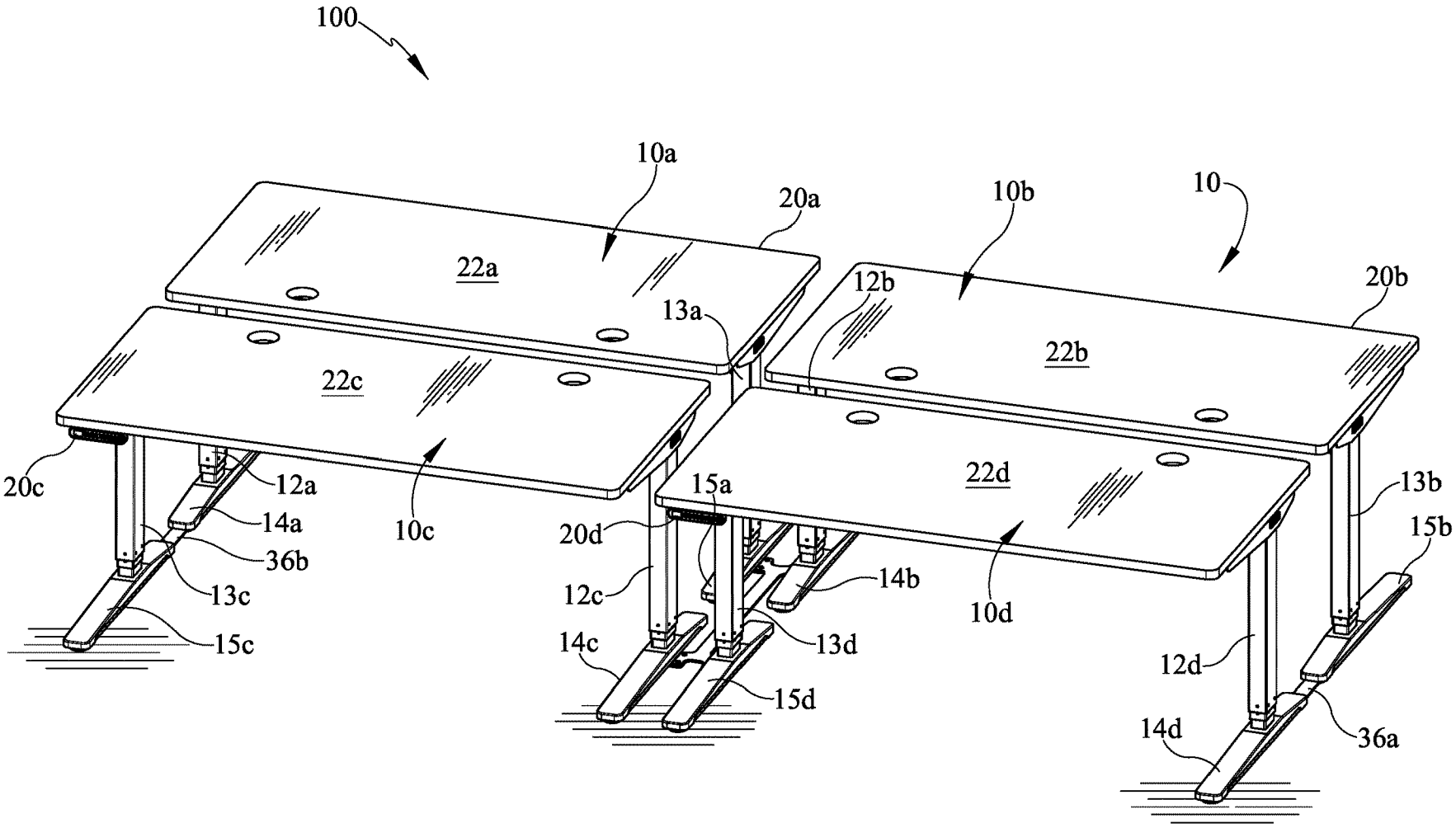
FIG. 1 depicts a desk benching system for a plurality of vertically adjustable desks in which implementations as disclosed and described herein may be implemented.

As shown in FIG. 1, the benching system 100 may create a grouping of vertically adjustable desks 10 wherein each of the vertically adjustable desk 10*a*, 10*b*, 10*c* and 10*d* are benched to form a combined grouping of vertically adjustable desks. In implementations, each of the vertically adjustable desks may include a horizontal work surface 22*a*, 22*b*, 22*c* and 22*d* supported by vertically adjustable right and left legs for each desk, namely 12*a*/13*a*, 12*b*/13*b*, 12*c*/13*c*, and 12*d*/13*d*. The vertically adjustable legs each may be attached to a right and left foot, such as 14*a*/15*a*, 14*b*/15*b*, 14*c*/15*c*, and 14*d*/15*d*. In embodiments, the vertically adjustable desks may also each include keypads or electrical switch respectively shown as 20*a*, 20*b*, 20*c* and 20*d* which allows the user to variously move and adjust the desks vertically.

In some implementations, the desks may be vertically adjustable by at least one electric motor or drive which is affixed to vertical adjustment mechanisms in each of the vertically adjustable right and left legs. An electric motor or drive 11 (FIG. 2) may be positioned underneath the horizontal work surface 22*a*, for example, and be actuatable by the electric switch 20*a* or keypad for user interaction. Each individual horizontally adjustable desk may be accordingly adjusted by a similar drive or motor and, in some implementations, may be replaced by manual adjustment mechanisms. For example, the desks may be electrically adjustable by electric motor or drives which actuate gears positioned within the vertically adjustable legs 12*a* and 12*b*. In addition, or in place thereof, the electric drive or motors may include manual vertical adjustment mechanisms which allow the user to manually adjust the height of the horizontal work surface 22*a* by either lifting, hand cranking, or the like, with positioning locks for each leg.

In the descriptions hereof, aspects described for a single desk may be applicable to each desk shown in the figures. As well, various modifications may be made to the multiple desks described herein such that combinations of features may be utilized to achieve similar goals and features set forth. Thus, descriptions of a single vertically adjustable desk are not necessarily applicable to each vertically adjustable desk utilized in the system.

Depicted in the embodiment of the various Figures are a plurality of vertically adjustable desks which form, in the depicted embodiment, a quadrant group of vertically adjustable desks. The group of vertically adjustable desks 10 include four desks 10*a*, 10*b*, 10*c* and 10*d* which are in side to side and front to front relationship in this particular embodiment. Particularly, the first and second vertically adjustable desks 10*a* and 10*b* are in side to side relationship while the third and fourth desks 10*c* and 10*d* are similarly positioned. The grouping of horizontally adjustable desks placed in side by side relationship may also be grouped with another grouping of desks in side by side relationship so that the two groups of horizontally adjustable desks are positioned in front facing relationship. In some implementations, such groupings can be in adjacent relationship. For example, in some implementations, the grouping can form a quadrant of two side to side groups placed in face to face relationship. In other embodiments, multiple groupings can be in full side by side relationship to form a linear pairing. In other examples, groupings can be done in quadrants, triads or other plurality of combinations.

Figure 2:
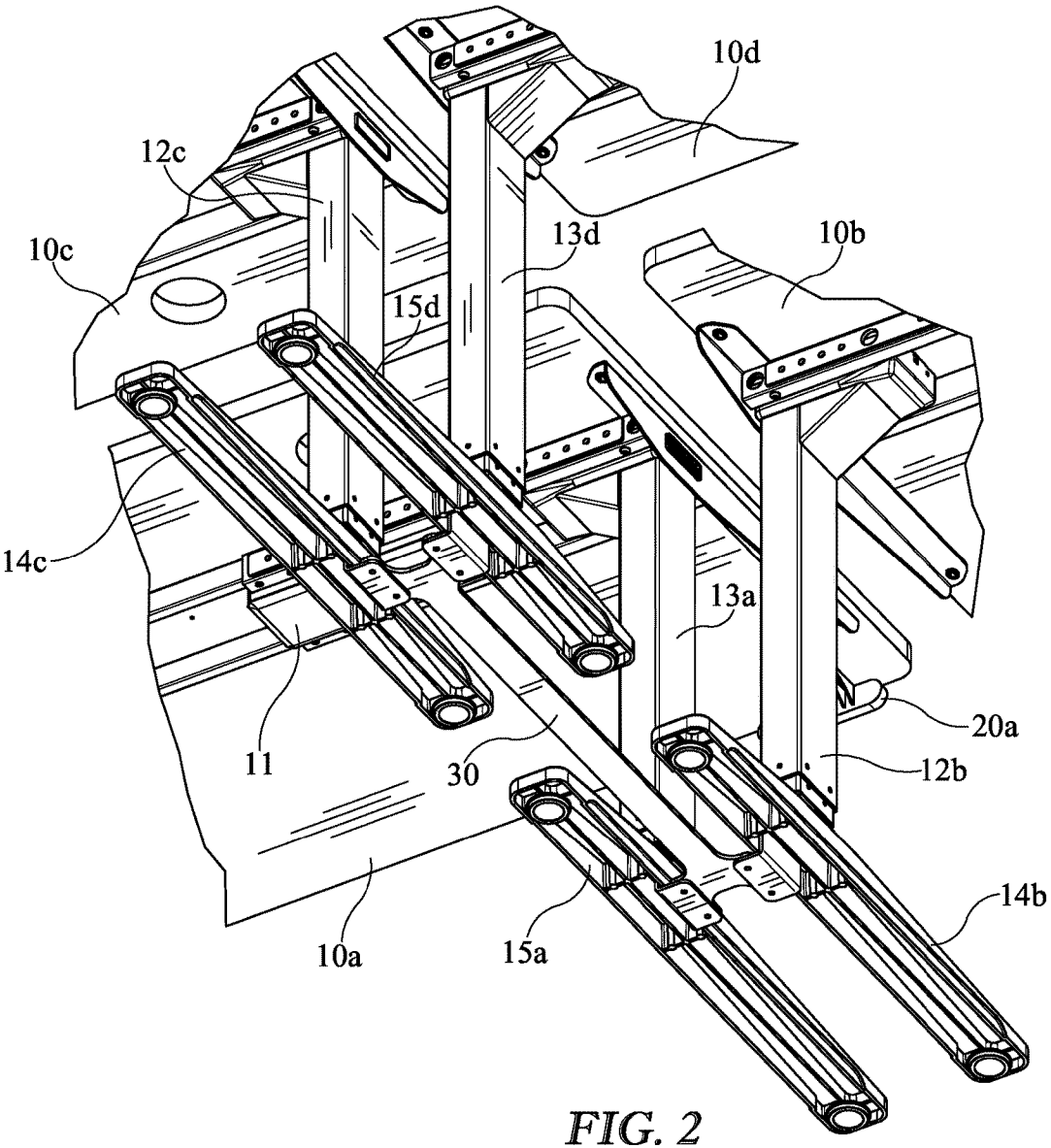
FIG. 2 depicts a main bracket which may be used in the benching system in implementations as disclosed and described herein.

As depicted in FIGS. 1 and 2, the plurality of vertically adjustable desks may be combined by use of a main bracket 30 which may be attached to adjacent vertically adjustable legs, as depicted in FIG. 2 being 12*a*, 12*c*, 13*b* and 13*d*. For example, in some implementations, the main bracket 30 can be directly attached to the legs or to the support foot of the respective leg, such as 14*a*, 14*c*, 15*b* and 15*d*. In implementations, the main bracket 30 may be constructed of steel or other rigid material and may be directly affixed to the leg or the foot. For example, in the embodiment of FIG. 2, the bracket 30 is removably affixed to the foot of the respective vertically adjustable leg.

Figure 3:
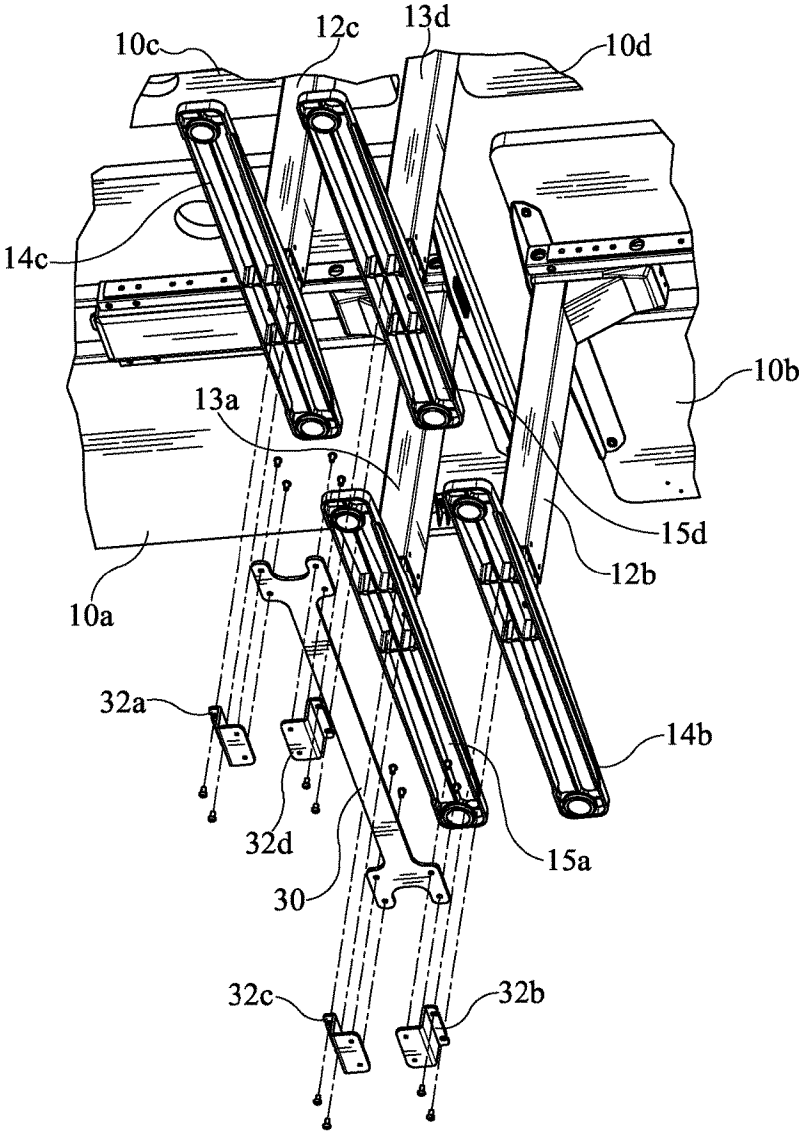
FIG. 3 depicts an exemplary exploded view of the main bracket of FIG. 2.

As depicted in FIG. 3, the main bracket 30 may have an interposing structure between the main bracket and the respective vertically adjustable leg or support foot. For example, the main bracket may have a plurality of offset brackets 32*a*, 32*b*, 32*c*, 32*d* which are removably affixed to the main bracket 30. In other implementations, the main bracket 30 may be directly and removably affixed to the support foot or vertically adjustable leg. For example, the support bracket may be affixed by screws directly to the adjacent and joining structure.

Offset brackets 32*a*, 32*b*, 32*c* and 32*d* may be utilized to allow the main bracket 30 to be vertically above or below the attachment point of the main bracket. For example, in some implementations, the main bracket 30 may be positioned above the affixation point of the offset brackets 32*a-d* by the offset brackets having an offset structure. For example, the offset brackets 32*a-d* affix to the support foot at a vertical position above the main brackets 30 vertical position interposed between the plurality of support foot 14*a*, 14*c*, 15*b*, 15*d*. In such implementation, the main bracket is positioned directly adjacent to the supporting floor surface while the offset brackets are attached to a position on the foot above the floor for securing the main bracket 30 in position.

Offset brackets 32*a-d* may be variously positioned on the main bracket 30. For example of FIG. 3, offset brackets 32*a*, 32*b*, 32*c* and 32*d* are positioned at the four outer corners of the main bracket 30. Alternatively, the offset brackets may be affixed at alternative locations of the main bracket such as closer to the center of the bracket. Alternatively, the offset brackets may be integrated directly into the main bracket so that the main bracket includes the vertical offset attachment structures of the offset brackets depicted. For example, the main bracket 30 may have at various locations offset flanges to receive the removable screws or studs for affixation.

Figure 4:
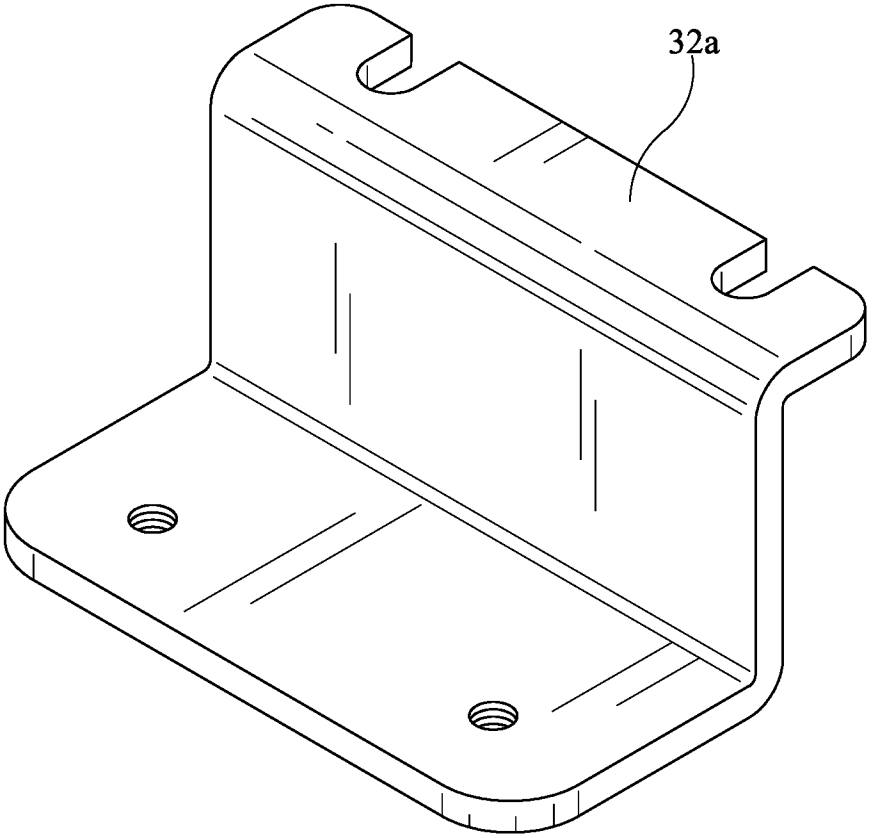
FIG. 4 depicts one implementation of an offset bracket utilized as disclosed herein.

The offset bracket 32*a*, depicted in FIG. 4 may combine both threaded apertures or receiving channels which may slidably receive adjustable structure on the receiving support foot or vertically adjustable leg, such as a threaded stud or other structure. While the offset bracket 32*a* has both slidable receiving channels and apertures, any combination of structures may be utilized. For example a combination of slidable receiving channels and apertures, as shown in the example of FIG. 4 or various other combinations.

In other implementations, the main bracket may be affixed at alternative locations between the respective support foot or vertically adjustable legs. Further, in some implementations, multiple pairs of desks can be connected in series by a plurality of main brackets 30 so that long chains of vertically adjustable desks can be formed and connected utilizing the main brackets 30 and end brackets 36*a*, 36*b* disclosed herein.

Figure 5:
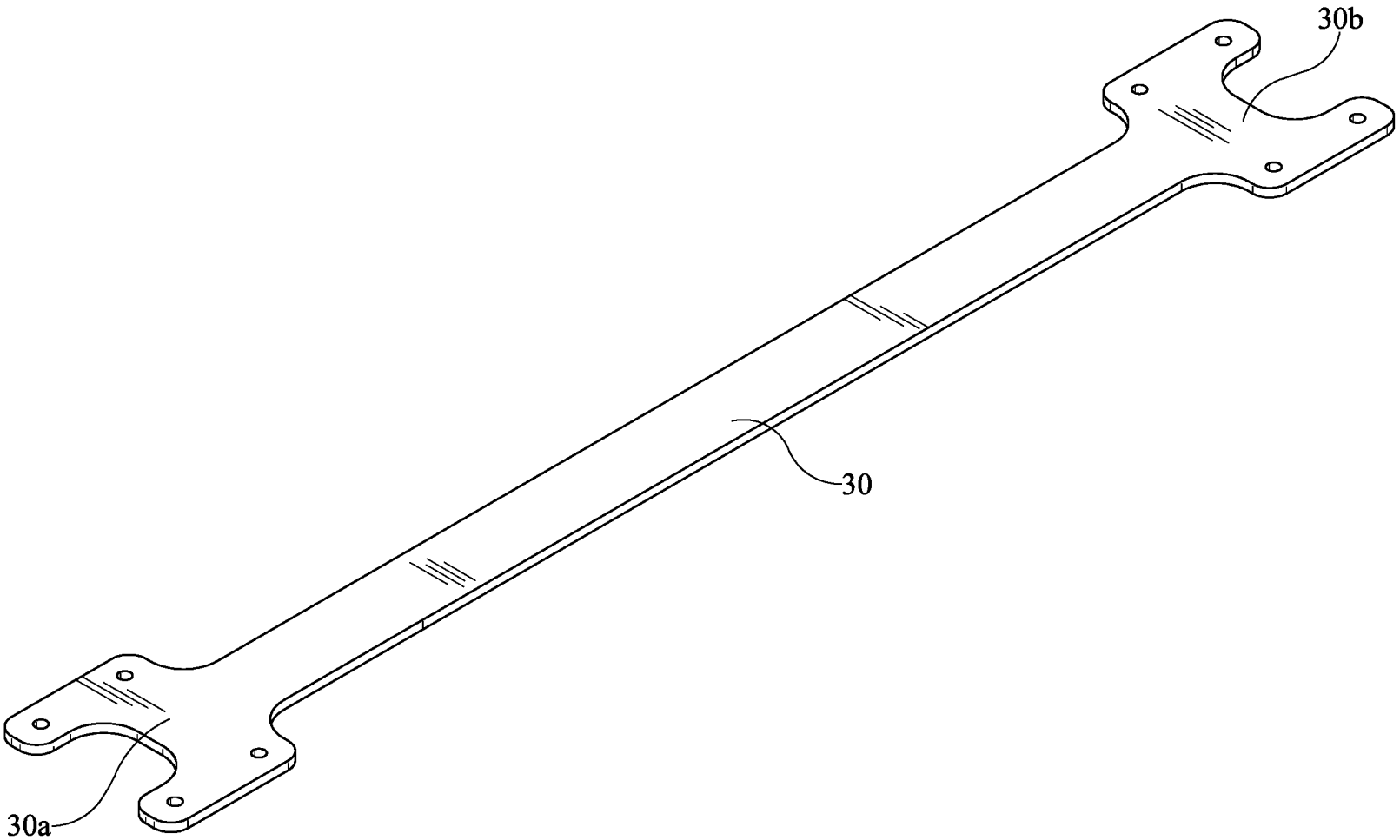
FIG. 5 depicts one implementation of a main bracket utilized as disclosed herein.

Referring to FIG. 5, the main bracket 30 may also be constructed in a length and having attachment points for the respective plurality of vertically adjustable desks. For example, the main bracket may include first and second ends 30*a* and 30*b* where each of the pair of the offset brackets are affixed. Also, for example, the main bracket may be positioned and sized to appropriately accommodate multiple work surface sizes of both depth and length.

Figure 6:
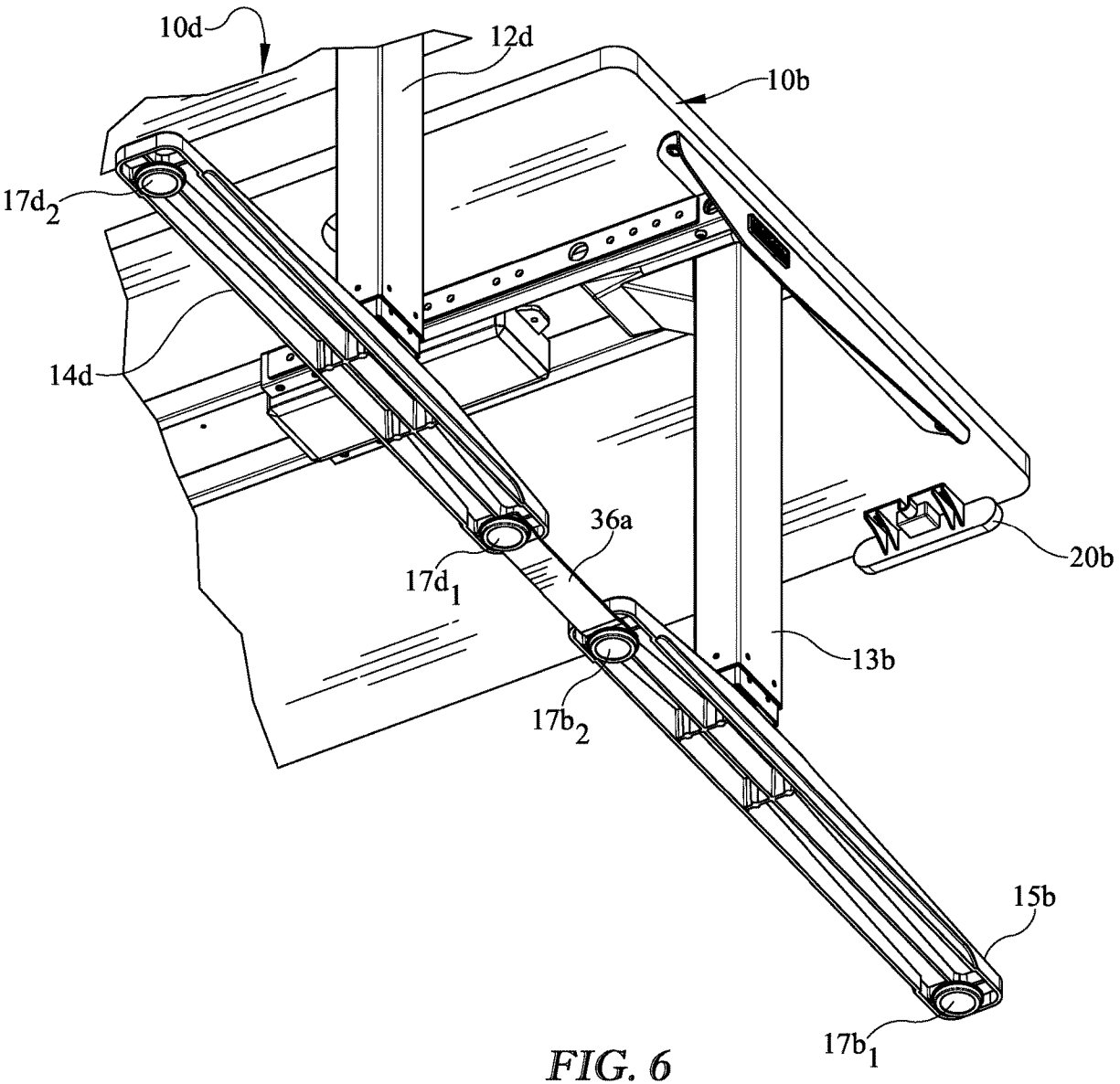
FIG. 6 discloses one method of joining adjacent desks using the end bracket in implementations as disclosed and described herein.
Figure 7:
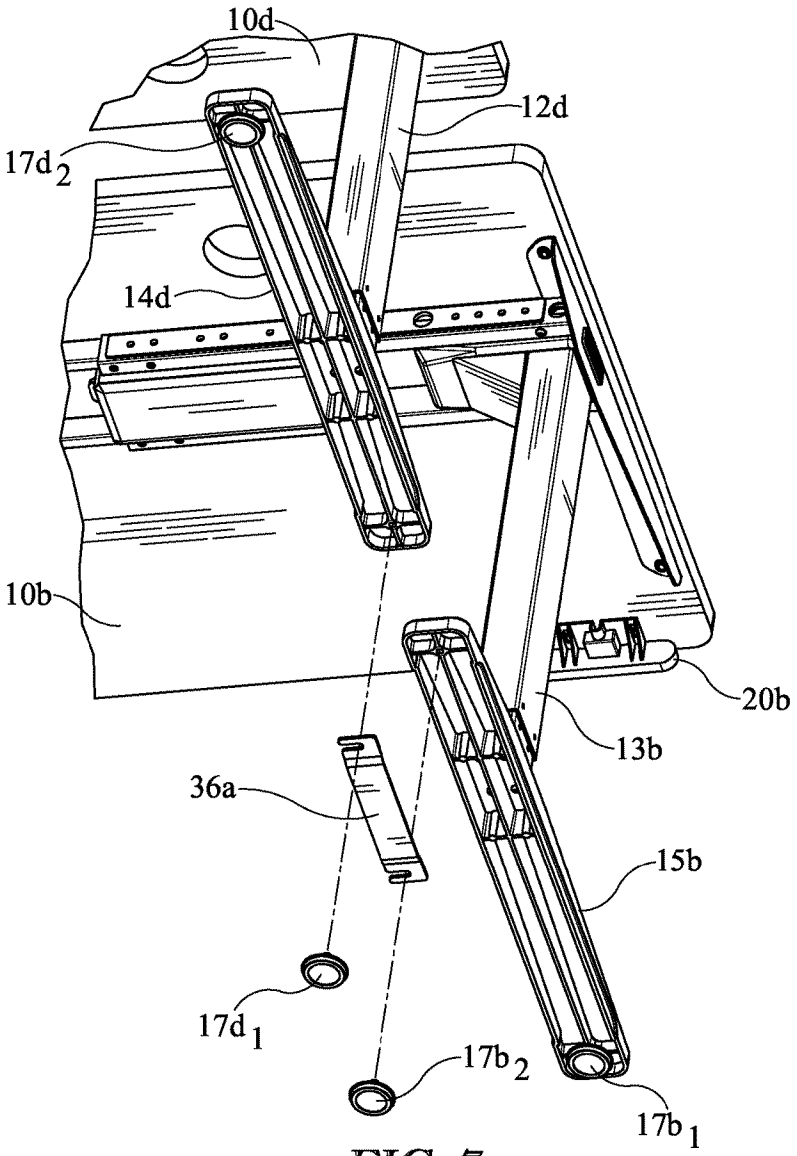
FIG. 7 discloses an exploded view of the end bracket utilized in the implementation of FIG. 6.

Referring to FIGS. 6 and 7, in some implementations, the main bracket 30 may be combined with end bracket 36*a* which may be used to affix the free unattached end support feet of the combined vertically adjustable desks. For example, as depicted in FIGS. 1 and 6, the end brackets 36*a*, 36*b* may be used to affix the free ends on the outboard side of the combined quadrant of desks depicted. In the embodiment depicted, the second and the fourth vertically adjustable desk 10*b* and 10*d* may be combined at the free ends by using the end bracket 36*a* depicted in the example shown. The end bracket 36*a* may be affixed to the support foot at the leveling pads 17*d*1 and 17*b*2 or similar adjustable casters. Opposing leveling pads 17*b*1 and 17*d*2 may therefore not have to be utilized for affixation of the desks. Leveling pads 17*d*1 and 17*b*2, as depicted variously throughout, may also include casters or other adjustable mechanisms to modify the leveling height of the support foot and ultimately the working surface of the vertically adjustable desk.

Figure 8:
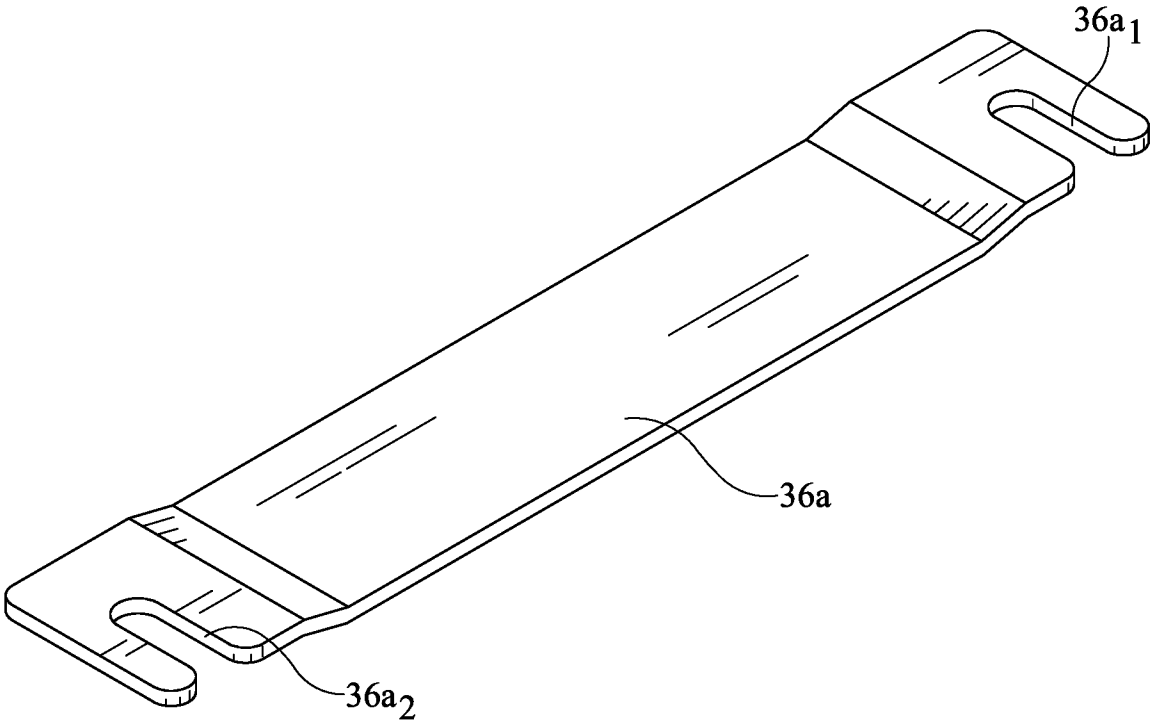
FIG. 8 depicts one implementation of an end bracket utilized as disclosed herein.

Referring to FIG. 8, end bracket 36*a* has a slidable receiving channel 36*a*1 and 36*a*2 which may affix to various structures on the vertically adjustable desk. For example, the end bracket 36*a* may receive the leveling pads 17*d*1, 17*b*2 which are affixed to a threaded stud and which therefor may be adjustable into or within the respective support foot. Similarly, by affixing the end bracket at opposition of the leveling pad, the end bracket may be located along the supporting floor and not in an obtrusive or highly visible location. Alternatively, the end brackets may be positioned at other locations along the adjacent vertically adjustable legs or support feet.

Opposing end of the combined plurality of vertically adjustable legs may also include a similar end bracket structure 36*b*. For example, an end bracket 36*b* may be utilized to fixedly secure the opposing end of the combined plurality of vertically adjustable desks 10*a* and 10*c*.

Figure 9:
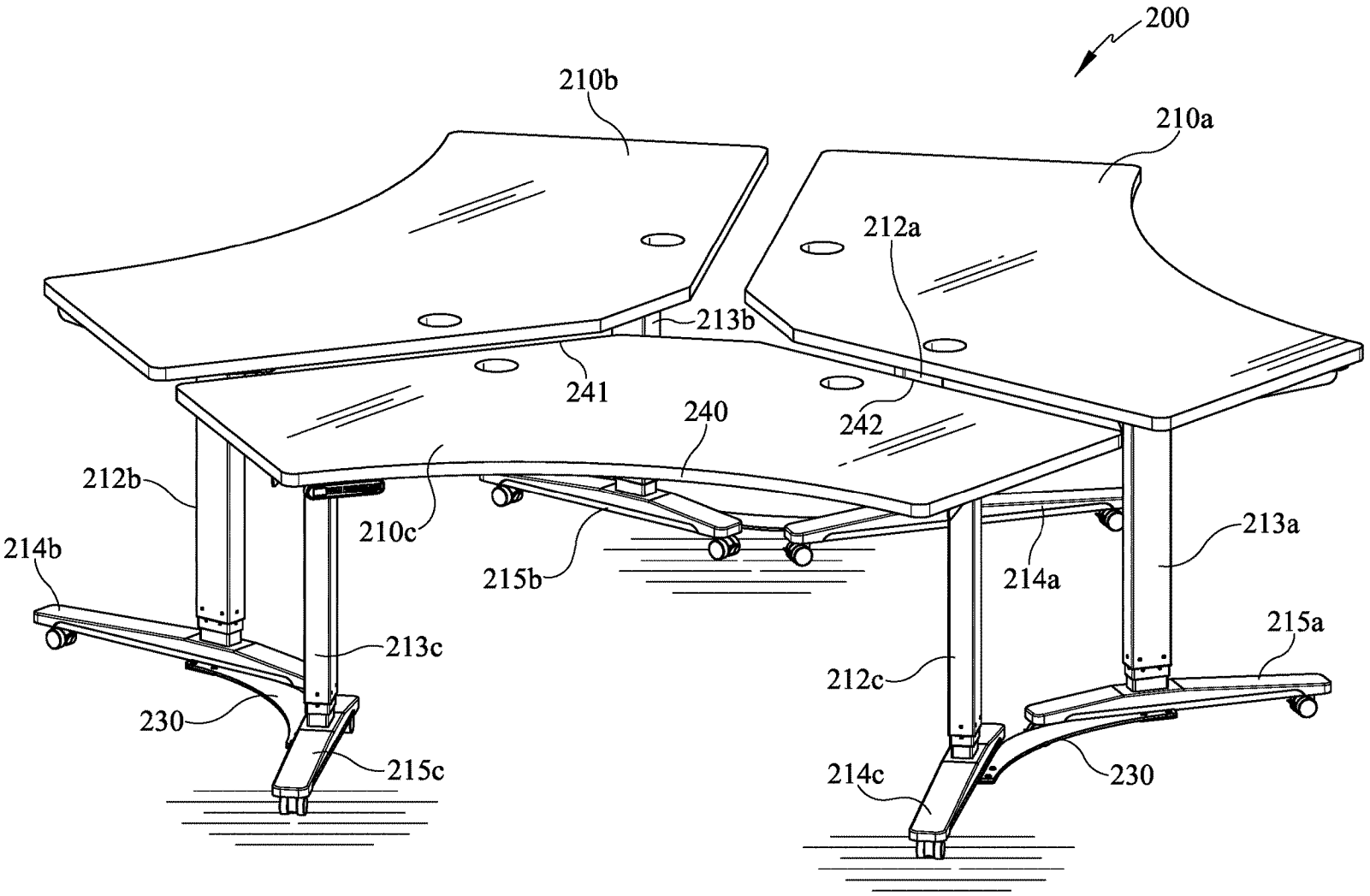
FIG. 9 depicts an alternative desk benching system for a plurality of vertically adjustable desks in which implementations as disclosed and described herein may be implemented.

Other formations of utilizing the benching system described herein may be implemented. For example, a plurality of three vertically adjustable desks 200 is depicted in FIG. 9 wherein a vertically adjustable desks 210*a*, 210*b* and 210*c* may be combined. The vertically adjustable desks may similarly have first and second vertically adjustable support legs 212*a*, 212*b*, 212*c*, 213*a*, 213*b* and 213*c*. Additionally, the vertically adjustable support legs may also include support foot 214*a*, 214*b*, 214*c*, 215*a*, 215*b* and 215*c*.

When arcuate interior edge desks are implemented as shown in this example, an interior curved desk edge with outer linear edges may be combined into a benching system connected plurality of desks. For example, in some implementations desk 210*a* and 210*c* may be joined at the adjacent support feet.

For example, support foot 215*a* of vertically adjustable desk 210*a* may be connected to support foot 214*c* of vertically adjustable desk 210*c*. Various connecting structures may be utilized for the benching system to removably affix and attach the two legs or support feet together. For example, arcuate main bracket 230 may be utilized to attach to both adjacent feet while also remaining unobtrusive and similarly out of the leg space or leg well of the vertically adjustable desk.

Figure 10:
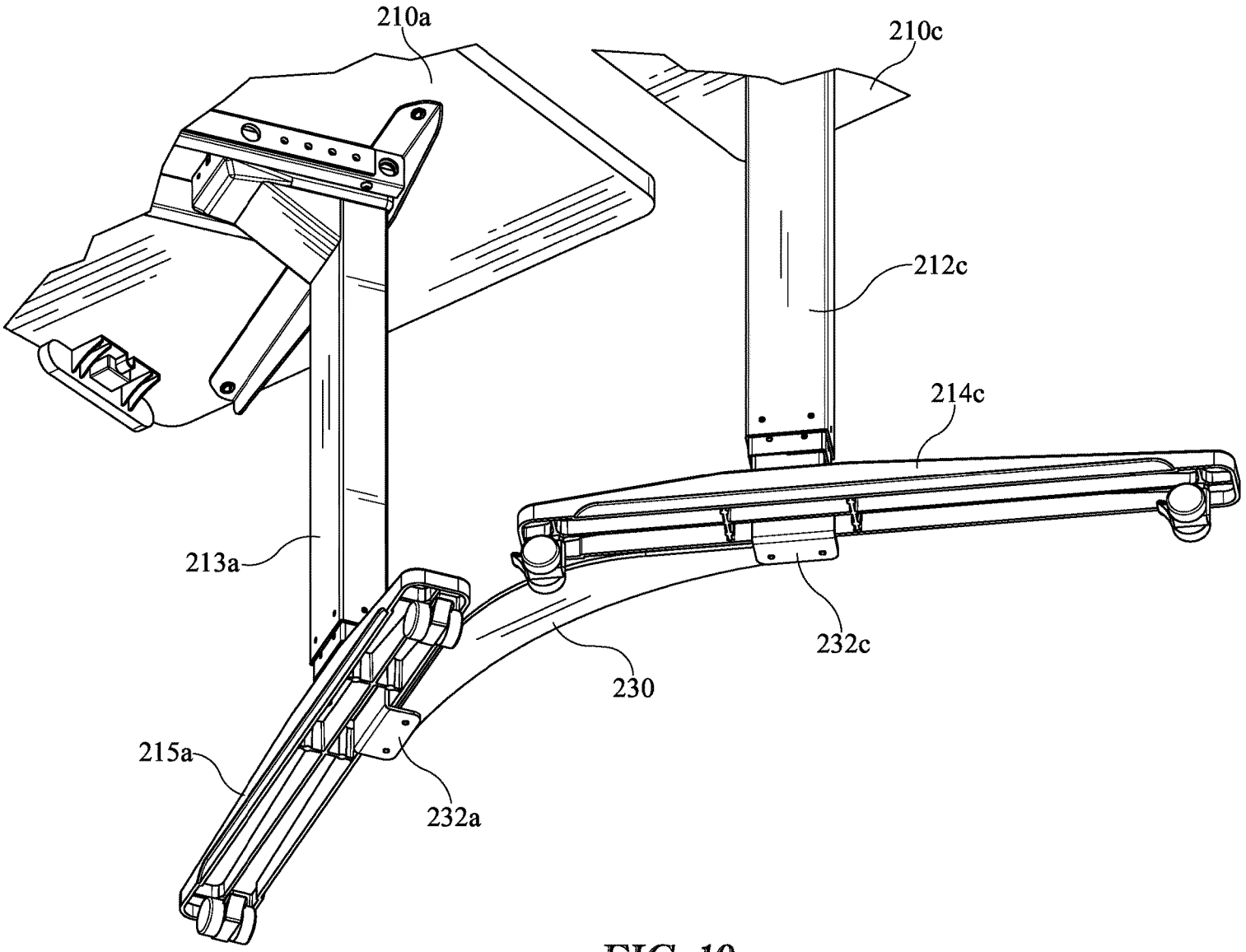
FIG. 10 depicts an arcuate main bracket which may be utilized in the embodiment depicted in FIG. 9.
Figure 11:
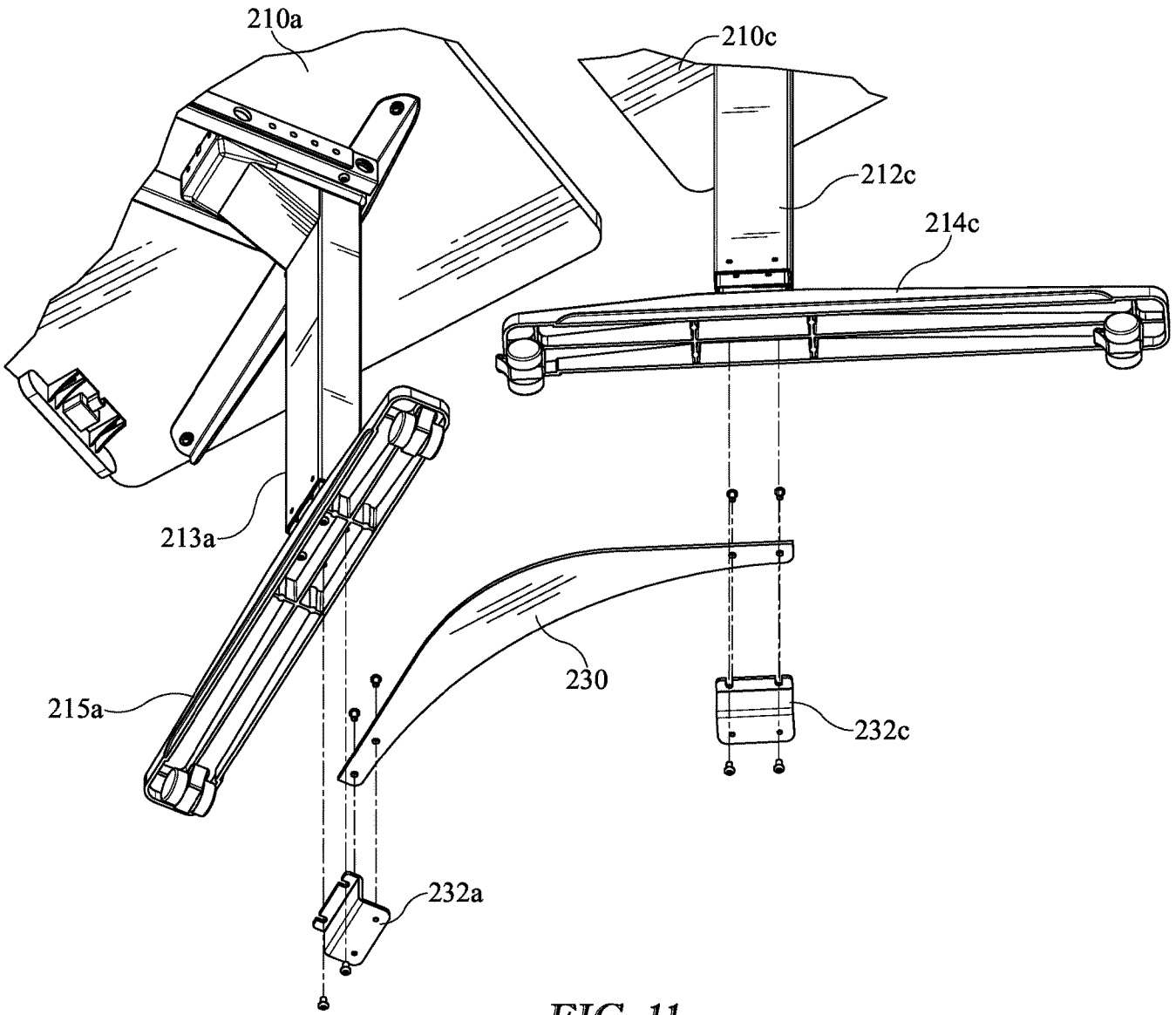
FIG. 11 depicts an arcuate main bracket in an exploded view which may be utilized in the embodiment depicted in FIG. 9.

In various implementations, the attaching mechanism may be used to affix adjacent vertically adjustable legs or attached support feet on desks. For example, arcuate attachment bracket 230, as shown in FIGS. 9-11, may by removably attached to adjacent feet of an adjacent desk. In the depiction of the configuration of the embodiment depicted, the arcuate bracket 230 removably affixes at either end to offset bracket 232*a*, 232*c* such that the arcuate bracket may attach to the underside of the support foot 215*a* and 214*c*.

In implementations, the arcuate bracket may include offset brackets 232*a*, 232*c* so that the arcuate bracket is positioned at a lower vertical height than the attachment point of the bracket to the respective support foot. In implementations, the offset connection may be made by using offset structure at the ends or other positions of the arcuate bracket. For example, in some embodiments, the arcuate bracket may have offset brackets 232*a*, 232*c* affixed at either end. In other embodiments, the offset structure may be made integral with the bracket itself not necessarily requiring separate offset brackets. For example, in some implementations, the arcuate bracket 230 may have flanges to effectuate the offset attachment or may be used to directly attach to the support foot or the vertically adjustable leg at any vertical position or height.

Figure 12:
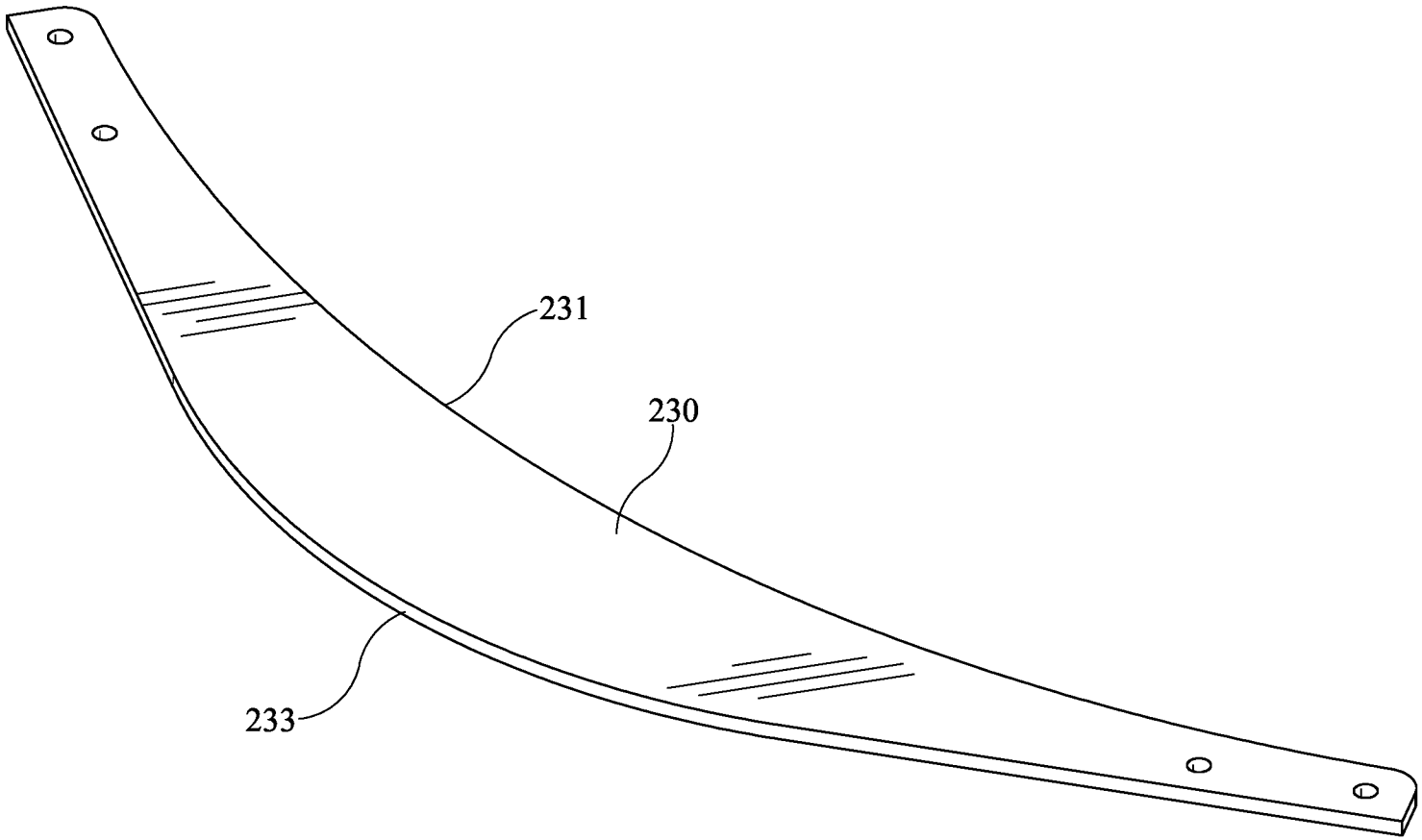
FIG. 12 depicts an arcuate main bracket which may be utilized in various implementations described herein.

With reference to FIG. 12, the arcuate bracket 230 may have an inner arcuate edge 231 and an outer arcuate edge 233 which allows the arcuate attaching bracket to be affixed and also maintain the connecting structure closely adjacent to the support feet being connected.

Beneficially, the plurality of vertically adjustable desks 200 depicted in FIG. 9 may have lateral adjoining face to face edges while also incorporating an arcuate interior edge which the user faces. For example, as depicted in FIG. 9, vertically adjustable desk 210*c* has an arcuate or curved inner edge 240 while also having lateral edges 241 and 242 which allow the opposing desks 210*a* and 210*b* to be directly adjacent to form the triad plurality of desks. Other implementations and configurations however may be implemented in order to adjoin additional various configurations of desks while achieving the same effect of combining the desks in a benching system as depicted and described herein.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A vertically adjustable desk benching system, comprising:

a plurality of vertically adjustable desks, each of the plurality of vertically adjustable desks including:

a work surface supported by a first and a second telescoping leg;

at least one electric motor operably connected to the first and the second telescoping leg;

an electrical switch in electrical connection with the at least one electric motor to activate the at least one electric motor to cause the first and second telescoping leg to raise or lower the work surface;

the first telescoping leg having a first foot and the second telescoping leg having a second foot;

a main bracket affixed to the first telescoping leg of each of the plurality of vertically adjustable desks, the plurality of vertically adjustable desks includes at least four vertically adjustable desks, the main bracket affixed to each of a first telescoping legs of each of four vertically adjustable desks;

a first end bracket affixed to the second telescoping leg of a first subset of the plurality of vertically adjustable desks;

a second end bracket affixed to the second telescoping leg of a second subset of the plurality of vertically adjustable desks.

2. The vertically adjustable desk benching system of claim 1 wherein the at least four desks positioned in a quadrant substantially forming a rectangle.

3. The vertically adjustable desk benching system of claim 1 wherein the main bracket is affixed to each of the plurality of vertically adjustable desks at the first foot on the first telescoping leg.

4. The vertically adjustable desk benching system of claim 3 wherein the main bracket attaches to an underside of each of the first foot on the first telescoping leg.

5. The vertically adjustable desk benching system of claim 4 wherein the main bracket is an I beam bracket.

6. The vertically adjustable desk benching system of claim 3 wherein the main bracket has four corners, each of the four corners of the main bracket affixing to a single one of the first foot on the first telescoping leg for the respective one of the plurality of vertically adjustable desks.

7. The vertically adjustable desk benching system of claim 6 wherein, each of the four corners having a main bracket support, each respective main bracket support attachable to a respective one of the first foot on the first telescoping leg of the respective vertically adjustable desk.

8. The vertically adjustable desk benching system of claim 7 wherein each of the main bracket supports are a vertically offset main bracket support.

9. The vertically adjustable desk benching system of claim 1 wherein the first end bracket slidably receives a first leveling pad on the second foot for each of the first subset of the plurality of vertically adjustable desks.

10. The vertically adjustable desk benching system of claim 1 wherein the second end bracket slidably receives a first leveling pad on the second foot for each of the second subset of the plurality of vertically adjustable desks.

11. A vertically adjustable desk benching system, comprising:

a plurality of vertically adjustable desks, each of the plurality of vertically adjustable desks having:

a horizontal work surface supported by first and second vertically adjustable legs, each of the first and second vertically adjustable legs having a support foot;

the first and second vertically adjustable legs operably engaged to at least one electric drive, the at least one electric drive having a switch to activate the at least one electric drive and cause the first and second vertically adjustable legs to vertically adjust the height of the supported horizontal work surface;

wherein the at least one electric drive includes a first and a second electric drive operably connected respectively to the first and the second vertically adjustable legs, the first and the second vertically adjustable legs telescoping to vertically adjust the height of the supported horizontal work surface;

the plurality of vertically adjustable desks positioned in a side to side and front to front quadrant and adjacent relationship;

a main bracket removably affixable to at least one of the first and second vertically adjustable legs of each respective one of the plurality of vertically adjustable desks, the plurality of vertically adjustable desks including four vertically adjustable desks, the main bracket removably affixable to each of the first telescoping legs of each of the four vertically adjustable desks;

a first and a second end bracket each removably affixed to a pair of the opposing one of the first and second vertically adjustable legs of each respective one of the plurality of vertically adjustable desks opposite the vertically adjustable leg affixable to the main bracket.

12. The vertically adjustable desk benching system of claim 11 wherein the main bracket is affixed to the at least four vertically adjustable desks.

13. The vertically adjustable desk benching system of claim 11 wherein each support foot for the first and the second vertically adjustable legs extends away from the respective vertically adjustable leg to first and second distal end.

14. The vertically adjustable desk benching system of claim 11 wherein the main bracket has four attachment points.

15. The vertically adjustable desk benching system of claim 14 wherein each of the four attachment points is removably affixed to the support foot of the first vertically adjustable leg of each one of the respective plurality of vertically adjustable desks.

16. The vertically adjustable desk benching system of claim 15 wherein the main bracket is substantially I-shaped.

17. The vertically adjustable desk benching system of claim 15 wherein each of the four attachment points has an offset bracket support positioned between the main bracket and the respective support foot.

18. The vertically adjustable desk benching system of claim 11 wherein each of the first and second end brackets has a first and a second U-shaped channel each of which receives a stud supporting a leveling pad on the respective support foot of the respective vertically adjustable leg.

19. A vertically adjustable desk benching system, comprising:

a plurality of vertically adjustable desks, each of the plurality of vertically adjustable desks having:

a horizontal work surface supported by first and second vertically adjustable legs, each of the first and second vertically adjustable legs having a support foot;

the first and second vertically adjustable legs operably engaged to at least one electric drive, the at least one electric drive having a switch to activate the at least one electric drive and cause the first and second legs to vertically adjust the height of the supported horizontal work surface;

wherein the at least one electric drive includes a first and a second electric drive operably connected respectively to the first and the second vertically adjustable legs, the first and the second vertically adjustable legs telescoping to vertically adjust the height of the supported horizontal work surface;

a main bracket removably affixable to the support foot of at least one of the first and second vertically adjustable legs of each respective one of the plurality of vertically adjustable desks, the plurality of vertically adjustable desks includes four vertically adjustable desks, the main bracket affixed to each of the first telescoping legs of each of the four vertically adjustable desks;

a first end bracket removably affixed to a first pair of support feet of the first and second vertically adjustable legs of each respective one of the plurality of vertically adjustable desks which are unaffixed to the main bracket;

a second end bracket removably affixed to a second pair of support feet of the first and second vertically adjustable legs of each respective one of the plurality of vertically adjustable desks which are unaffixed to the main bracket.

20. A vertically adjustable desk benching system, comprising:

a plurality of vertically adjustable desks, each of the plurality of vertically adjustable desks having:

a horizontal work surface supported by first and second vertically adjustable legs, each of the first and second vertically adjustable legs having a support foot;

the first and second vertically adjustable legs operably engaged to at least one electric drive, the at least one electric drive having a switch to activate the at least one electric drive and cause the first and second legs to vertically adjust the height of the supported horizontal work surface;

wherein the at least one electric drive includes a first and a second electric drive operably connected respectively to the first and the second vertically adjustable legs, the first and the second vertically adjustable legs telescoping to vertically adjust the height of the supported horizontal work surface;

the plurality of vertically adjustable desks each having an arcuate interior edge and angled exterior edges wherein the plurality of vertically adjustable desks can form a triad of three vertically adjustable desks, the triad of vertically adjustable desks positioned such that the support foot of the first vertically adjustable leg of each of the plurality of vertically adjustable desks is adjacent to the support foot of the second vertically adjustable leg of an adjacent desk from the plurality of vertically adjustable desks;

a plurality of arcuate main brackets, each of the arcuate main brackets removably affixable to the support foot of the first vertically adjustable leg and the support foot of the second vertically adjustable leg of an adjacent vertically adjustable desk;

wherein each of the plurality of arcuate main brackets have a first and a second end, an arcuate interior edge and an arcuate exterior edge, the first end and the second end of each of the plurality of arcuate main brackets affixable to an offset bracket which is affixed to respective support foot.

* * * * *